United States Patent [19]

Sallee et al.

[11] Patent Number: 4,527,493

[45] Date of Patent: Jul. 9, 1985

[54] FABRIC BAND MAKING MACHINE

[76] Inventors: John P. Sallee, Manson Pike, Rte. #10, Murfreesboro, Tenn. 37130; Dennis Liggett, P.O. Box 329, Goodlettsville, Tenn. 37072

[21] Appl. No.: 484,139

[22] Filed: Apr. 12, 1983

[51] Int. Cl.[3] ..... D05B 23/00

[52] U.S. Cl. ..... 112/121.27; 112/121.29

[58] Field of Search ..... 112/121.27, 121.29

[56] References Cited

U.S. PATENT DOCUMENTS

| | | | |
|---|---|---|---|
| 3,777,683 | 12/1973 | Lee | 112/121.27 |
| 3,780,679 | 12/1973 | Hanes et al. | 112/121.27 |
| 4,366,764 | 1/1983 | McCurry | 112/121.27 |

*Primary Examiner*—Ronald Feldbaum

*Attorney, Agent, or Firm*—Harrington A. Lackey

[57] ABSTRACT

An apparatus for securing the free ends of an elongated strip of flexible material to form a band, such as an elastic band for various types of apparel. The machine includes a securing station, such as a sewing station including a sewing machine, and an apparatus for drawing a strip of flexible material longitudinally beneath the securing station in a measuring path. A measuring device deflects a predetermined length of the strip downward away from the measuring path to form a measured open loop. A knife mechanism cuts the trailing end portion of the loop. Loading and clamping mechanisms position the free ends of the loop in the securing station for attachment, such as by stitching. An ejection mechanism withdraws the finished loop from the sewing station for discharge. The measuring device is provided with adjustment means for adjusting the length of the deflected loop and therefore the size of the completed band. The apparatus preferably includes an extraction mechanism for withdrawing the clamped, measured loop from the measuring path while the loop is being secured to permit initiation of the next measuring cycle.

18 Claims, 22 Drawing Figures

10
11
120
121
122
123
124
125
126
127
128
129
130
131
62
76

FABRIC BAND MAKING MACHINE

BACKGROUND OF THE INVENTION

This invention relates to an apparatus for making flexible bands, and more particularly to an apparatus for making flexible fabric bands for use in apparel.

Machines for making flexible bands, and particularly elastic fabric bands for use in the manufacture of apparel, in which a strip of fabric material is measured and cut and the free ends sewn together, are known in the art.

Moreover, the concept of feeding an elongated strip of fabric material beneath a sewing machine by clamping its lead edge and pulling the strip beneath the sewing machine, subsequently deflecting a portion of the strip beneath the sewing machine to form a measured loop, clamping the end portions, cutting the trailing end portion of the deflected loop, placing the trailing and leading edges of the loop upon the sewing machine work plate, and subsequently stitching the overlapping ends of the deflected loop together and ejecting the completed loop, is known in the art.

However, the mechanism for measuring or forming the deflected loop presently in use, includes a transverse measure rod which is mounted on the free end of an elongated pivotally mounted arm. The adjustment of the pivotal sweep of this arm in order to permit the formation of deflected loops of various lengths for the manufacture of different sizes of fabric bands, is somewhat complicated, and requires an excessive amount of down-time for each length adjustment. Moreover, the pivotally mounted measuring arms now in use, occupy an extensive amount of space for carrying out the function of measuring the length of the deflected loop.

Furthermore, the ejection mechanism in current use for ejecting and discharging the completed bands from the sewing machine utilize a pivotal ejection arm supporting a hook for engaging and removing the completed band through the swinging motion of the ejection arms. Not only does this swinging arm ejection mechanism occupy an unnecessary amount of space, but also the cycle of feeding and pulling the next strip of fabric into its measuring position must be delayed until the previous band is completed and removed from the sewing machine, thus, limiting the number of bands that can be made per unit of time. Furthermore, a swinging ejection mechanism must swing through greater areas to remove bands of greater length, resulting in timing and adjustment problems for bands of different lengths.

Heretofore, in the feeding the the fabric strip toward the measuring and sewing stations, some of the fabric strip portions, which are wrinkled or twisted, must be manually straightened, requiring unnecessary downtime.

SUMMARY OF INVENTION

It is therefore an object of this invention to provide an apparatus for making a fabric band basically utilizing the original concept of feeding and pulling a flexible fabric strip through a measuring station beneath a sewing station, deflecting the fabric strip to form a deflected open loop of a pre-determined length, clamping and cutting the end portions of the open loop and placing the end portions upon the sewing plate in an overlapping position for stitching by the sewing machine, and then removing the completed band from the sewing machine.

However, the measuring mechanism utilized in this apparatus is considered unique in its structure and function, and is also provided with an adjustment mechanism for quickly and easily adapting the measuring mechanism for measuring deflected loops of various desired lengths.

Furthermore, this apparatus contemplates a loop extraction mechanism for withdrawing the clamped open loop from the measuring path of the fabric strip to permit the initiation of the next measuring cycle while the first loop ends are being stitched, thereby condensing the length of each band cycle to improve the production of the flexible fabric bands.

This apparatus is particularly adapted for the fabrication of flexible elastic fabric bands which are to be used in various types of apparel, such as underwear and outer wear for both men and women. Accordingly, this apparatus utilizes a tensionless feed mechanism for feeding the elastic fabric strips, and also for measuring the strips, without any perceptible elongation of the elastic strips.

The apparatus also includes an ejection clamping mechanism of novel structure, which initially places the free ends of the open loop into their final position for securing or stitching by the sewing needle and for holding these ends in place while stitching, as well as for removing the completed loop from the sewing station and for discharging the completed loop to a discharge station, such as a receptacle.

The apparatus also includes a unique oscillating feed mechanism for straightening the fabric strip before it is measured.

In this apparatus both the measuring mechanism and the ejection mechanism have linear or reciprocable motions, instead of pivotal motions, for more positive action and to minimize space requirements.

Other advantages of this apparatus will become apparent from the detailed description of the apparatus.

DESCRIPTION OF THE PREFERRED EMBODIMENT

Figures 1, 2, 3, 4, 5:
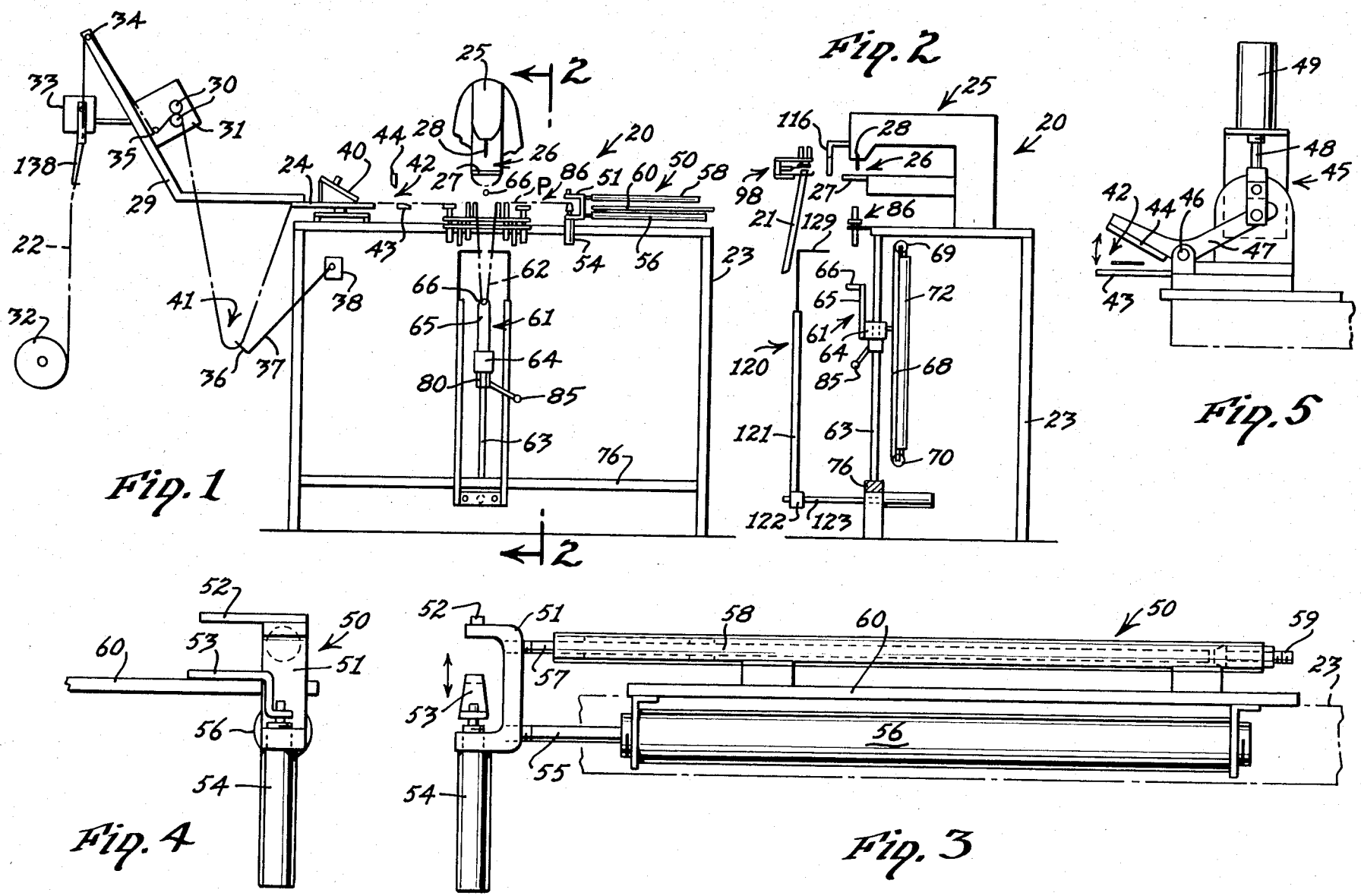
FIG. 1 is a schematic front elevation of the apparatus, made in accordance with this invention, with the measuring device in its operative position for forming a measured deflected loop in the fabric strip.
FIG. 2 is a section taken along the line 2—2 of FIG. 1.
FIG. 3 is an enlarged fragmentary side elevation of the pull clamp mechanism.
FIG. 4 is a left end elevation of the pull clamp mechanism disclosed in FIG. 3.
FIG. 5 is an end elevation of the knife mechanism, schematically disclosed in FIG. 1.

Referring now to the drawings in more detail, FIGS. 1 and 2 disclose an apparatus 20 for making a flexible band 21 (FIG. 2) from an elongated strip of flexible material, such as an elastic fabric strip 22.

The machine or apparatus 20 includes a frame 23 having a horizontally disposed longitudinal feed track or guide 24, shown at the left hand side of the frame 23 in FIG. 1.

Fixed to and above the frame 23 is a conventional sewing machine head 25 having a stitching station 26 including a work plate 27 adapted to support the fabric strip 22 for stitching, and a vertically reciprocable needle 28 adapted to carry a thread reciprocably through the fabric strip in a known manner.

An arm 29 extending from the left side of the frame 23 as viewed in FIG. 1, supports a pair of feed rollers 30 adapted to be driven by a motor 31 for feeding a fabric strip 22 toward the frame 23 from a fabric strip source, such as the fabric supply roll 32. The fabric strip 22 is guided through an oscillating feed mechanism 33 and over the transverse guide bars or rollers 34 and 35 to the feed rollers 30.

From the feed rollers 30, the fabric strip 22 passes through a guide loop 36 on the free end of an elongated pivoted tension arm 37 operatively connected to an electric switch 38 electrically connected to the feed motor 31 for starting and stopping the feed motor 35. From the guide loop 36, the fabric strip passes over the guide track 24, where it is held in a stationary position by the pivotally mounted pawl 40.

Thus, the tension arm 37 is adapted to maintain a tensionless or slack loop 41 in the fabric strip 22 by controlling the actuation of the feed motor 31. As the loop 41 gets deeper or larger, the weight of the tension arm 37 will actuate the switch 38 to stop the feed motor 31 to prevent the accumulation of anymore fabric within the slack loop 41. However, as the fabric strip 22 is drawn toward the right of FIG. 1, over the guide track 24 to reduce the size of the loop 41, the tension arm 37 will be raised actuating the switch 38 to re-start the feed motor 31, feeding more of the fabric strip from the supply roll 32 to the slack loop 41. In this manner, the fabric strip 22, particularly an elastic fabric strip, for which the apparatus 10 is particularly adapted, will be fed and transferred with a minimum of tension, to prevent stretching or expansion of the fabric strip 22.

As the fabric strip 22 passes over the guide track 24, it will move past a cutting station 42 including a stationary lower knife blade 43 and a moveable upper knife blade 44, both extending transversely of the feed path of the fabric strip 22.

An example of one form of cutting mechanism 45 which can be utilized at the cutting station 42 is disclosed in FIG. 5. The cutting mechanism 45 includes the stationary lower blade 43 adapted to cooperate with the upper moveable blade 44 which is pivotally mounted about the pivot pin 46 and is integral with a pivotal knife arm 47 connected to a piston rod or plunger 48 controlled by the pneumatic cylinder 49.

As disclosed in FIGS. 1, 3 and 4, a pull-clamp mechanism 50 is mounted on the frame 23 on the opposite side of the sewing head 25 from the fabric guide 24 and in substantial horizontal alignment therewith. The clamp mechanism 50 may include a C-shaped clamp frame 51 having an upper fixed jaw 52. Opposing the upper jaw 52 is a lower moveable jaw actuable by a fluid motor or cylinder 54 supported in the lower part of the clamp frame 51. Actuation of the fluid cylinder 54 causes the lower clamp jaw 53 to move toward and engage the upper fixed clamp jaw 52.

The C-shaped clamp frame 51 is fixed to a piston rod 55 actuable by a fluid cylinder 56. The clamp frame 51 is also provided with an elongated guide rod 57 slideable in the guide cylinder 58. An adjustment stop screw 59 in the rear of the guide cylinder 58 provides a means for adjusting the longitudinal horizontal travel of the clamp frame 51.

The pull-clamp mechanism 50 may be fixed to the frame 23 by means of the mounting plate 60.

A measuring device of mechanism 61 is provided directly below the sewing machine head 25 and longitudinally between the cutting station 42 and the pull-clamp mechanism 50. The function of the measuring mechanism 61 is to deflect downward a portion of the fabric strip 22 pulled into the measuring path P beneath the sewing head 25 by the pull-clamp mechanism 50 in order to measure a pre-determined deflected open loop 62 (FIGS. 1 and 6).

The measuring mechanism 61 includes a vertically disposed and fixed guide rod 63 upon which vertically travels a guide member or guide block 64. The guide block 64 supports an upstanding arm 65 to which is fixed a forwardly projecting, horizontally disposed, measure rod 66. The measure rod 66 is located directly below the sewing machine head 25 and in substantial vertical alingment with the axis of the sewing needle 28. In its inoperative upper position, the transverse measure rod 66 lies above and transversely over the measuring path P of the fabric strip 22. However, when the measure rod 66 is forced downward, it engages and deflects downward a portion of the fabric strip 22, to form the open loop 62. The depth of the loop 62 is determined by the downward travel of the measure rod 66.

Figure 6:
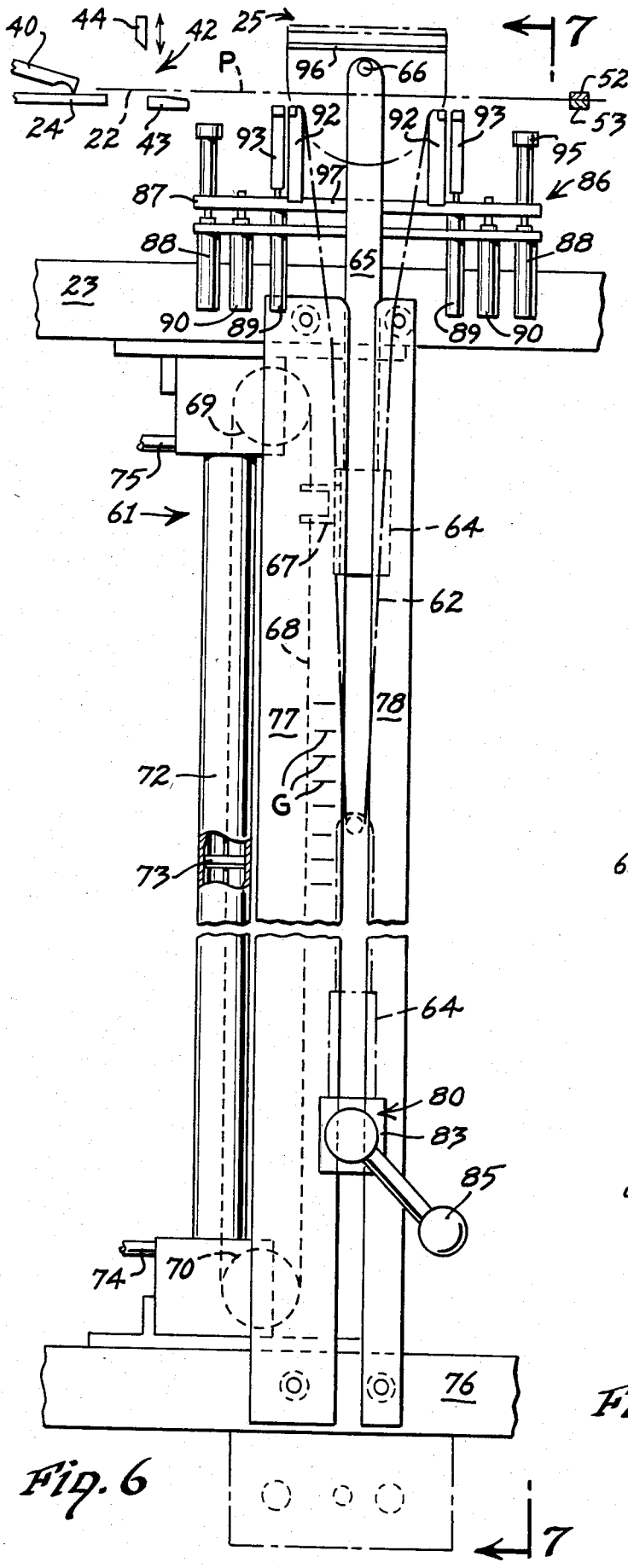
FIG. 6 is an enlarged, fragmentary front elevational view of the loop measuring device.

In order to vertically reciprocate the measure rod 66, the guide block 64 is provided with a bracket 67 fixed to the opposite ends of a chain or cable 68, or other inelastic flexible linear member, trained about the upper and lower pulleys or sheaves 69 and 70 (FIG. 6). The cable 68 extends longitudinally through the fluid cylinder 72 where it is fixed to a piston 73 adapted to reciprocate within the cylinder 72. When hydraulic or pressurized fluid is introduced into the cylinder 72 through the lower inlet conduit 74, the piston 73 is driven upward to drive downward the measure rod 66. Simultaneously the fluid on the upper side of the piston 73 is exhausted through the upper conduit 75. By reversing the flow of hydraulic fluid through the conduits 75 and 74 and the cylinder 72, the measure rod 66 is raised to its upper inoperative position shown in solid lines in FIGS. 6 and 7.

Both the hydraulic cylinder 72 and the vertical guide rod 63 are fixed between an upper portion of the machine frame 23 and a lower frame member 76.

A pair of guide rails 77 and 78 are also fixed between the upper portion of the machine frame and the lower horizontal frame member 76 to provide a vertical guide slot therebetween in vertical alignment with the travel of the horizontal measure rod 66.

The lower limit of travel of the measure rod 66 is determined by the adjustable stop member 80, which includes a rear clamp plate 81 having a stop flange 82 and a front clamp member 83. The clamp members 83 and 81 are moved toward and away from each other by the rotary threaded stud 84 controlled by the rotary clamp handle 85. By releasing the clamp mechanism in the stop member 80, the stop flange 82 may be located in any vertical position along the clamp plates 77 and 78, such as the solid-line position disclosed in FIGS. 6 and 7.

The left guide plate 77 may include the graduations G, which are calibrated to correspond with different desired band lengths. Thus, when a particular band length is desired, the stop member 80 is moved to register with one of the graduation marks G, and a band 21 having the indicated length will be produced by the apparatus 20.

Figure 7:
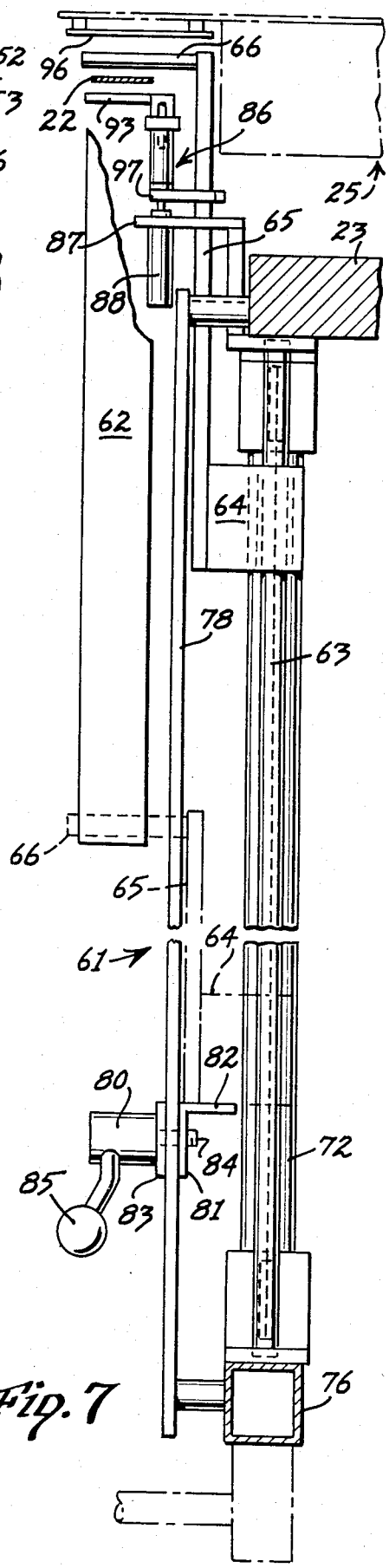
FIG. 7 is a section taken along the line 7—7 FIG. 6.
Figures 8, 9, 10, 11:
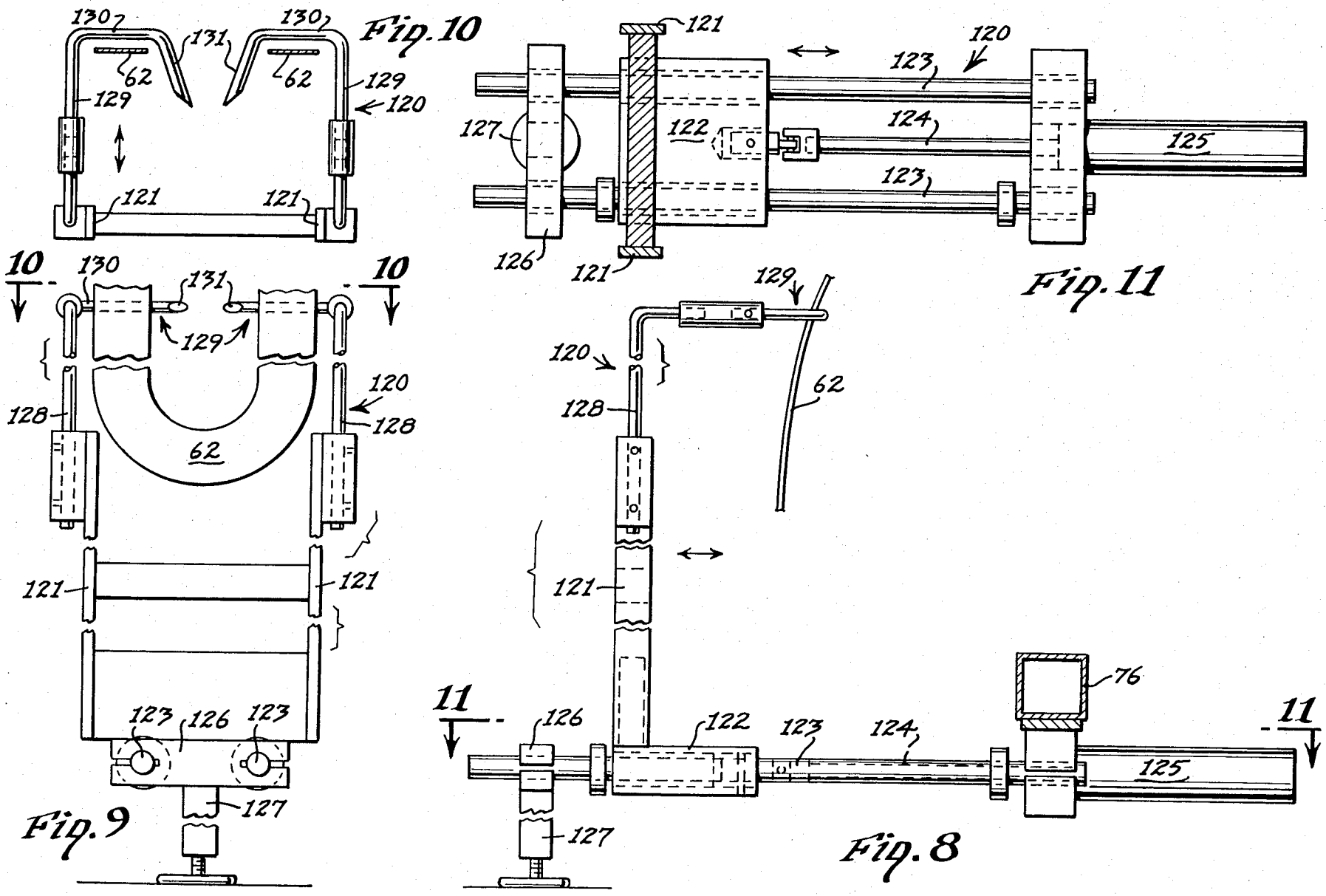
FIG. 8 is a fragmentary end elevational view of the loop extraction mechanism disclosed in FIG. 1, with portions broken away.
FIG. 9 is a front elevational view of the loop extraction mechanism disclosed in FIG. 8, with portions broken away.
FIG. 10 is a top plan view taken along the line 10—10 of FIG. 9.
FIG. 11 is a fragmentary section taken along the line 11—11 of FIG. 8.

As the hydraulic cylinder 72 causes the measure rod 66 to descend, the block 64 will continue to travel until it engages the stop flange 82, such as illustrated in phantom in FIG. 7, to stop the measure rod 66 at its lowermost position to form the open loop 62 of the desired depth. The stop flange 82 engaging the block 64 will override any further movement of the cable 68 even though the hydraulic cylinder 72 is still actuated.

With reference to FIGS. 6, 12, 13 and 14, a loop loading mechanism 86 is located slightly below the measuring path P of the fabric strip 22, and astride the open loop 62 for clamping and loading the upper ends of the open loop 62 upon the sewing machine head 25. The loop loading mechanism 86 includes a cylinder mounting bar 87 fixed to a portion of the frame 23. The cylinder mounting bar 87 supports a pair of stop cylinders 88 and a pair of clamp cylinders 90. These pairs of cylinders are disposed symmetrically about the axis of the vertical path of reciprocation of the measure rod 66. The piston rods 91 actuated by the fluid clamp cylinders 90 are fixed to a transverse clamp carriage 97 to which are fixed the upward projecting clamp fingers 92.

The push-up or lift cylinders 89 are slidably mounted in the cylinder mounting bar 87 and are fixed to the clamp carriage 97. Thus, when the clamp carriage 97 moves upward with the clamp fingers 92, the push-up cylinders 89 along with the push-up fingers 93 actuated by the push-up cylinders 89 are likewise carried with the carriage 97.

The stop piston 94 actuated by each stop cylinder 88 extends slidably through the carriage 97 and terminates in an enlarged stop head 95.

A clamp plate 96 is fixed to the bottom of the sewing machine head 25 to cooperate with the clamp fingers 92 in clamping the opposite end portions of the open loop 62 between the fingers 92 and the clamp plate 96.

Figures 12, 13, 14:
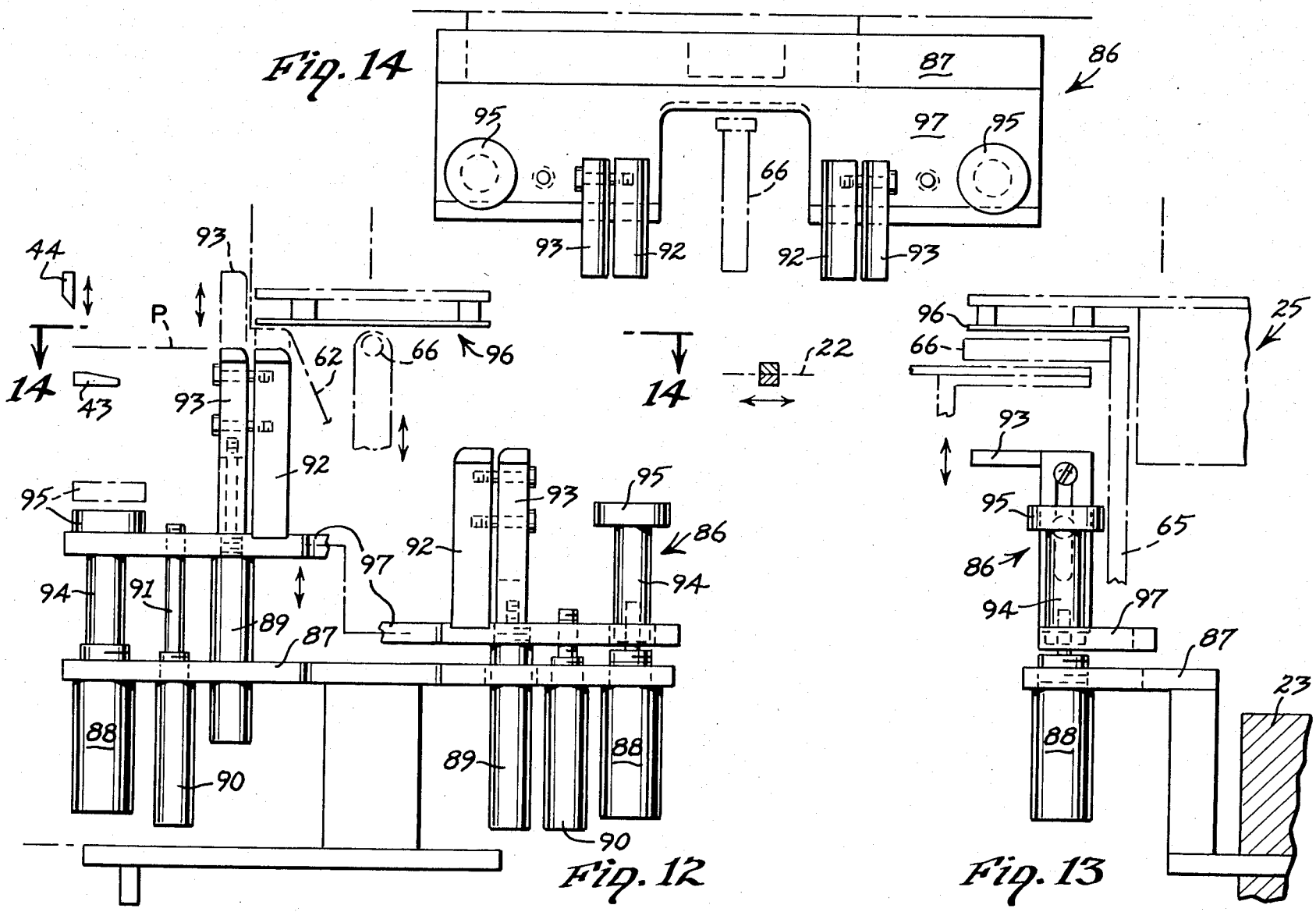
FIG. 12 is a fragmentary front elevational view of the loop loading mechanism.
FIG. 13 is a fragmentary right end elevation of the loop loading mechanism disclosed in FIG. 12.
FIG. 14 is a top plan view of the loop loading mechanism disclosed in FIG. 12.
Figure 15:
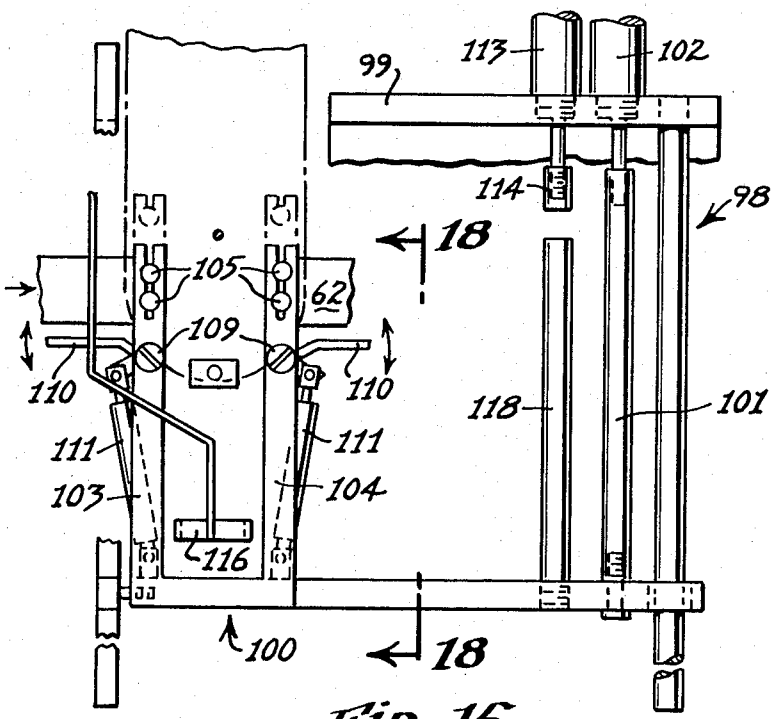
FIG. 15 is a fragmentary top plan view of the band ejection mechanism.
Figure 16:
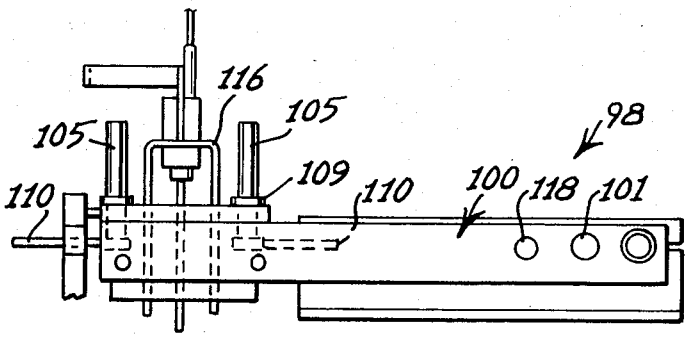
FIG. 16 is a front end elevational view of the ejection mechanism disclosed in FIG. 15.
Figure 17:
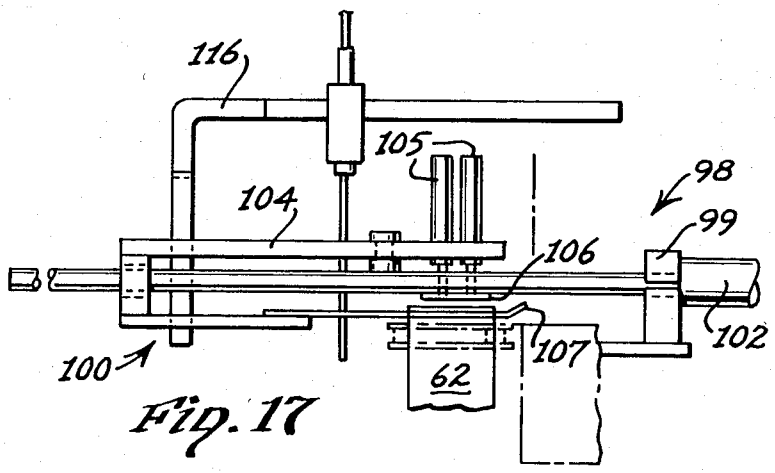
FIG. 17 is a fragmentary right end elevational view of the ejection mechanism enclosed in FIG. 15.
Figure 18:
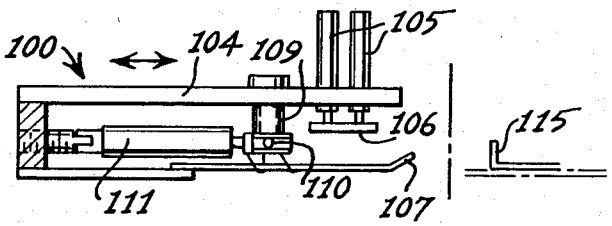
FIG. 18 is a section taken along the line 18—18 of FIG. 15.

The clamp carriage 97 is adapted to occupy a lower retracted position, as disclosed in the right-hand portion of FIG. 12 and also in FIG. 6, whereby all parts of the loading mechanism 86 will be out of the way of the reciprocal path of the pull-clamp mechanism 50. An intermediate measuring position of the clamp carriage 97 is disclosed in the left-hand portion of the carriage 97 in solid lines in FIG. 12, in which the clamp fingers 92 have their upper-clamp faces or tips substantially in the plane of the measuring path P to function as guides over which the upper end portions of the open loop 62 are held and guided during the measuring cycle. This measuring position is determined by the stop heads 95 which are locked in their solid-line positions disclosed in FIG. 12 by the stop cylinders 88.

When the pressure in the stop cylinders 88 is released to permit the stop heads 95 to float, the clamp cylinders 90 can then thrust the carriage to an upper clamping position in which the clamp fingers 92 clamp against the clamp plate 96, thereby clamping the upper end portions of the open loop 62 against the fixed clamp plate 96.

After the clamped end portions are cut by the knife blades 44 and 43, the cut free end portions of the open loop 62 project outward beyond the clamp fingers 92 and in the path of the push-up fingers 93. By actuation of the push-up cylinders 89, the push-up fingers 93 will protract upward to deflect the free end portions of the open loop 62 up along the sides of the sewing machine head 25, preparatory to having the free end portions deflected over the work plate 27 and into the stitching station 26.

The ejection mechanism 98 is best disclosed in FIGS. 15–19. The ejection mechanism 98 is mounted on a support bar 99 in front of the sewing machine head 25 for longitudinal movement toward and away from the sewing machine head 25. The ejection mechanism 98 includes a carriage frame 100 reciprocably movable front-to-rear by piston rod 101 actuated by the hydraulic cylinder 102.

The carriage frame 100 include a pair of rearward projecting arm members 103 and 104 supporting vertically disposed clamp cylinders 105 operating vertically reciprocable upper clamp shoes 106. The upper clamp shoes 106 are adapted to cooperate with the lower fixed clamp shoes 107.

Each arm 103 and 104 is also provided with a rotary shaft or stem 109 to which is fixed a wiper finger 110 which is free to swing in a horizontally rotary path. Each wiper finger 110 is controlled by a hydraulic wiper cylinder 111 to swing across the upstanding free ends of the open fabric loop 62 held against the sewing machine head 25 by the push fingers 93. The inward swinging wiper fingers 110 depress the loop ends and cause them to overlap each other in loading station 112 (FIG. 19) adjacent the sewing station 26. The clamp cylinders 105 are actuated to depress the upper clamp shoes 106 downward upon the fabric ends and hold them against the lower clamp shoes 107.

Figure 19:
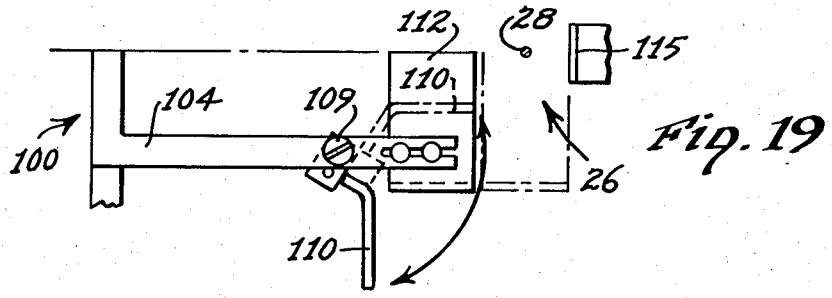
FIG. 19 is a fragmentary top plan view of the portion of the ejection mechanism disclosed in FIG. 18, with portions removed.
Figure 22:
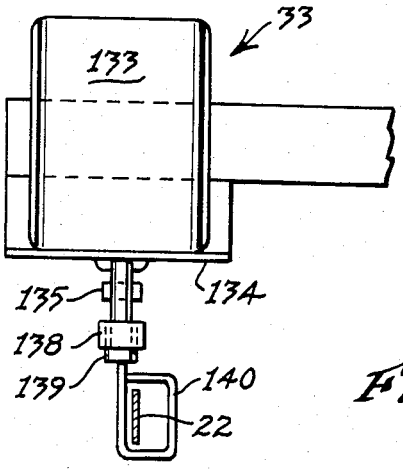
FIG. 22 is a fragmentary top plan view of the oscillating feed mechanism disclosed in FIG. 20.

After the free end portions of the fabric loop 62 are clamped in the loading station 112 as disclosed in FIG. 19, the ejector mechanism 98 is retracted to move the overlapping clamped fabric ends from the loading station 112 to the sewing station 26, as disclosed in FIGS.

15 and 19. This movement is accomplished by releasing the pressure on the stop cylinder 113, which normally supports a stop head 114 in the phantom load position disclosed in FIG. 15. When the pressure is relieved from the stop cylinder 113, pressure within the cylinder 102 causes the rod 118 to overcome the stop head 114 to move the overlapping fabric ends into the sewing station 26.

As illustrated in FIG. 19, when the overlapping fabric ends are moved into the sewing station 26, they abut against a fixed edge flange 115 to align the fabric edges before the stitching operation.

The ejector mechanism 98 remains in the retract position clamping the open ends in overlapping relationship as long as the stitching operation continues. After the needle 28 has completed its stitching of the overlapping ends of the open fabric loop 62, the controls, not shown, are automatically actuated to cause the ejection carriage 100 to protract forwardly, carrying with it the completed band 21. The clamp shoes 106 and 107 remain closed about the legs of the stitched completed fabric band 11. As the carriage 100 continues protracting to remove the band from the sewing machine head 25, a depending stationary fork member 116 engages the band while the upper clamp shoes 106 are retracted upward to release the band 11 from the ejection mechanism 98. The removed loop falls to a discharge site, not shown, such as a receptacle for the completed bands or a discharge conveyor, not shown.

Also mounted on the frame 23 in front of the sewing machine head 25, is a loop extraction mechanism 120 (FIGS. 2 and 8–11). The frunction of the loop extraction mechanism 120 is to remove the open loop 62 out of the fabric measuring path P as soon as the free ends of the open loop 62 have been clamped by the clamp fingers 92 against the clamp plate 96, to permit the initiation of the next measuring cycle without having to wait until the previous band is completely sewn and removed. The loop extraction mechanism 120 includes a pair of vertical standards 121 fixed upon a slide block 122 having bearings permitting it to travel along the slide rods 123 fixed to the horizontal machine frame member 76. The slide block 122 is connected to a piston rod 124 actuated by the hydraulic or fluid cylinder 125 also fixed to the frame member 76. As disclosed in FIGS. 8 and 9 the front ends of the guide rods 123 may be supported by a bracket 126 and an adjustable foot member 127.

Supported in the vertical standards 126 are corresponding vertically adjustable extension arms 128 which terminate in rearwardly projecting hook members 129. The hook members 129 oppose each other, having lateral bight portions 130 terminating in forwardly directed, converging free end portions 131. The converging free end portions 131 are so shaped that as the hook members 129 move rearwardly, the free end portions will engage and cam the depending legs of the suspended open loop 62 toward each other. After the legs of the loop 62 have cleared the free end portions 131 they will spring back to their original attitude, but now in alignment with, and in front of, bight portions 130 of the hook members for engagement therewith upon the forward travel of the hook members 129.

In the initial position of the extraction mechanism 120, the slide block 122 and hook members 129 are retracted rearwardly until the hook members 129 are behind the depending band legs far enough that the band legs will be captured by the hook members 129. Thus, upon the forward movement of the extraction mechanism 120, the lateral bight portions 130 will engage the legs of the open band loop 62 to carry them forward, out of the way of the longitudinal measuring path of the fabric strip 22. Thus, the open loop 62 is completely out of the way of the reciprocable path of the pull-clamp mechanism 50, so that the clamp member 51 may be projected to the area of the cutting station 42 for gripping the cut end of the continuous fabric strip 22.

Because of the extraction mechanism 120, the next measuring cycle can be initiated before the previous cycle of stitching the ends of the loop 62 and ejecting the fabric band 21, is completed, thereby reducing the operational time and improving the production of the apparatus 10.

It has been found that the apparatus 10 may operate to produce continuously as many as 14 bands per minute, as opposed to prior known machines which make approximately 10 bands per minute.

The purpose of the oscillating feed mechanism 33 is to oscillate or vibrate the initial portion of the fabric strip 22 being fed to the apparatus 10 from the supply roll 32 in order to straighten out the fabric strip 22 and to eliminate any folds, wrinkles or twisted portions.

Figure 20:
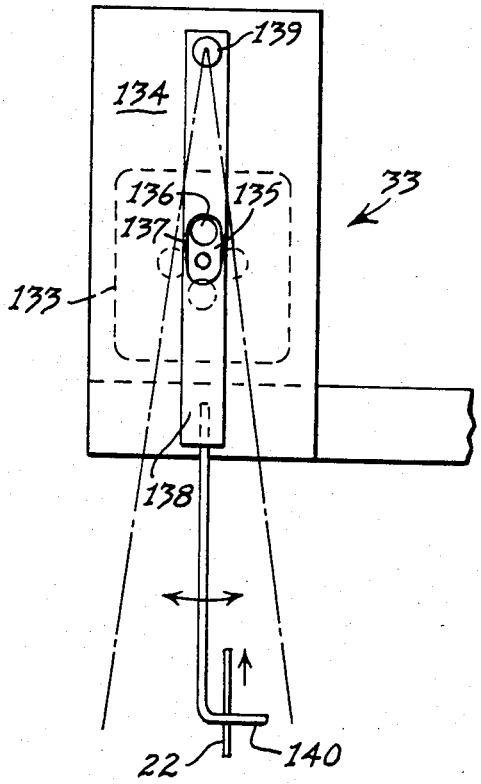
FIG. 20 is an enlarged fragmentary front elevational view of the oscillating feed mechanism.
Figure 21:
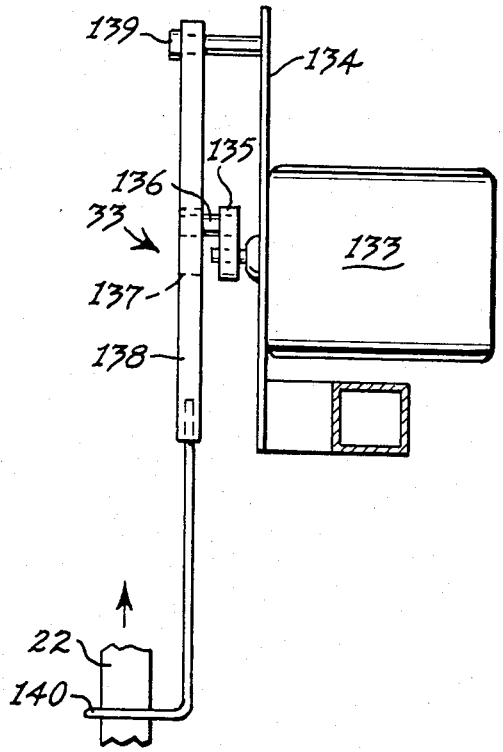
FIG. 21 is a right end elevation of the oscillating feed mechanism disclosed in FIG. 20.

As best disclosed in FIGS. 20–21 the oscillating feed mechanism 53 includes a rotary electric motor 133 fixed upon a bracket 134 connected to a portion of the frame arm 29 and adapted to drive a crank arm 135. The extremity of the crank arm 135 is connected to a cam roller 136 extending through an elongated slot 137 of an oscillating arm 138. The upper end of the oscillating arm 138 is connected to the mounting plate 134 by a pivot pin 139, while its lower end supports a guide loop 140 for receiving the fabric strip 22. Actuation of the motor 133 causes the oscillating arm 138 to oscillate rapidly about its pivot pin 139 and causes the guide loop 140 to rapidly shake or vibrate the fabric strip 22 to remove any folds or wrinkles from the strip in order to straighten the fabric strip 22 as it is fed to the guide track 24.

The operation of the apparatus 10 readily becomes apparent from the previous description of the structure and function of the various elements.

The elongated fabric strip 22 is fed from the roll 32 through the oscillating feed mechanism 33, where the folds and wrinkles are removed from the fabric strip 22 in order to straighten it. The fabric strip is then drawn over the guide rods 34 and 35 by the feed rollers 30 to the guide track 24, where the free end portion of the strip 22 is held against the track 24 by the weighted pivotal pawl 40.

A slack loop 41 is maintained in the fabric strip 22 between the drive feed rollers 30 and the guide track 24 by the pivotal tension arm 37 controlling the switch 38, which in turn controls the operation of the motor 31.

The controls for the sequential steps of the various mechanisms are of a conventional type, and they may include timer motors, timer switches and/or limit switches at appropriate locations.

After the fabric strip 22 is positioned with its free end at the cutting station 42, the pull-clamp mechanism 50 is actuated to cause the clamp frame 51 to project longitudinally beneath the sewing machine head 25 and toward the cutting station 42. When the clamp frame 51 is in the cutting station 42, the lower clamp 53 is actuated to grip the free end portion of the fabric strip 22 between the clamp jaws 52 and 53. Then, the pull-clamp mechanism 50 is retracted to draw the fabric strip along the measuring path P beneath the sewing machine head 25 and beneath the measure rod 66 in its upper inoperative position. When the pull-clamp mechanism 50 has reached its fully retracted position as disclosed in FIGS. 1 and 3, the free end of the fabric remains clamped by the clamp frame 51, preparatory to the measuring cycle.

The hydraulic cylinder 72 of the measuring mechanism 61 is then actuated to cause the measure rod 66 to move downward engaging and deflecting that portion of the fabric strip 22 in the measuring path, until the guide block 64 engages the stop flange 82.

At this point, the open loop 62 has been established to its desired depth.

About this time, the controls are sequenced to actuate the extraction mechanism 120 to move behind, capture and then move forward and engage the opposite legs of the open loop 62 to transfer the loop 62 out of the measuring path P of the fabric strip 22 to permit continued cycling of the apparatus 10.

The actuation of the cylinder 72 is then reversed to cause the measure rod 66 to return to its upper inoperative position. The upper end portions of the open loop 62 are clamped by the respective clamp fingers 92 against the fixed clamp plate 91, at which time the cutting mechanism is actuated to cut the fabric strip 22 and separate the open loop 62 from the rest of the strip 22.

The ejection mechanism 98 is actuated to cause the carriage 100 to retract toward the sewing machine head 25, causing the wiper fingers 110 to wipe the upper free ends of the fabric loop 62 across each other upon the sewing machine work plate 27 in the loading station 112. The upper clamp shoes 106 are depressed to grip the opposite end portions of the overlapping open loop 62. The carriage 100 is then retracted further to place the overlapping ends in the stitching station 26 while the sewing machine head 25 operates to stitch the ends of the open loop 62 together to form the completed band 21. The clamp shoes 106 and 107 remain closed while the carriage 100 protracts to remove the completed band from the sewing machine until the band is engaged by the depending fork member 116, the clamp shoes are opened and the band is discharged from the apparatus 20.

In order to make bands of a different length, the clamp member 80 is adjusted along the vertical track defined by the guide plates 77 and 78 to the desired position opposite the graduation marks G and the stop flange 82 is re-clamped in the new position. Such an adjustment operation requires a minimum of time in order to change over to the fabrication of the new fabric band of different length.

What is claimed is:

1. An apparatus for making a band from an elongated strip of flexible material comprising:

(a) a securing station for securing two end postions of a strip of flexible material together, (b) means for positioning an elongated strip of flexible material having a lead end in a measuring path below said securing station, (c) a measure rod extending transversely of said measuring path, (d) guide means operatively connected to said measure rod for guiding said measure rod in a vertical linear path from an upper inoperative position between said sewing station and said measuring path and a lower operative position in which said measure rod deflects the strip downward from said measuring path a pre-determined distance, (e) drive means for moving said measure rod along said vertical linear path, (f) adjustment means for varying the downward distance said measure rod travels, (g) knife means for severing the measured portion of the strip from the remaining portion of the strip, to form a loop of the flexible material, (h) means for clamping the end portions of the loop and for placing said end portions in said securing station, (i) ejection means for moving the loop from said securing station after said end portions have been secured.

2. The invention according to claim 1 in which said guide means comprises a vertical guide rod fixed below said securing station, a guide member adapted to travel reciprocably along said guide rod, said measure rod being connected to said guide member for movement therewith, and said drive means being operatively connected to said guide member for moving said guide member along said guide rod.

3. The invention according to claim 2 in which said adjustment means comprises a stop member and means for adjustably securing said stop member on said guide rod below said guide member in various vertically adjusted positions for limiting the downward movement of said guide member and said measure rod.

4. The invention according to claim 3 in which said stop member comprises means for adjustably clamping said stop member in any vertical position along said guide rod.

5. The invention according to claim 1 in which said ejection means comprises clamp means including two pairs of clamp jaws longitudinally spaced on opposite sides of said securing station, and means for opening and closing said pairs of clamp jaws, said ejection means further comprising means for moving said clamp means toward an operative position on opposite sides of said securing station for gripping the completed band when said jaws are closed and to an ejection position away from said securing station.

6. The invention according to claim 5 further comprising an ejection finger member projecting downward between said pairs of clamp jaws whereby movement of said clamp jaws towards said ejection position causes said ejection finger member to engage and strip said completed band from said clamp jaws.

7. The invention according to claim 1 further comprising loop extraction means including a pair of hook members disposed on opposite sides of and below said securing station, linear motive means for moving said hook members from a retracted position in which said hooks are normally behind a loop suspended from said securing station, and a forward extraction position in which said hook members engage the suspended loop in a deflected position removed from said measuring path.

8. The invention according to claim 1 further comprising an oscillating feed device for engaging and oscillating the strip upstream from said knife means as it moves toward said measuring path to remove the wrinkles from the strip.

9. The invention according to claim 8 in which said oscillating feed device includes a base and an arm pivotally mounted to said base, motor means for oscillating said arm relative to said base, and a guide on the freeend portion of said arm for carrying and oscillating the strip as the strip moves past said guide.

10. The invention according to claim 1 further comprising feed means for feeding the strip of flexible material towards said measuring path, and means responsive to the tension in the strip for controlling said feed means to maintain a slack loop in the strip upstream of said measuring path.

11. The invention according to claim 10 in which said feed means comprises feed rollers engaging the strip and means for driving said feed rollers, to move the strip toward said measuring path, said means responsive to the tension comprising a pivotal tension arm for engaging and forming a slack loop in the strip, operative means connected to said drive means and sensitive to the position of said tension arm for actuating said drive means when the loop formed by the tension arm is too slack and for stopping said drive means when the loop engaged by said tension arm is too taut.

12. An apparatus for making a band from an elongated strip of flexible material comprising:

(a) a securing station for securing two end portions of a strip of flexible material together, (b) means for positioning an elongated strip of flexible material having a lead end in a measuring path below said securing station, (c) measuring means for moving a loop of the strip from said measuring path downward below said securing station a predetermined measured distance to form a measured loop, (d) loop extraction means comprising a pair of hook members disposed on opposite sides of and below said securing station, and (e) linear motive means for moving said hook members from a retracted position in which said hooks are normally behind the measured loop, and a forward extraction position in which said hook members engage the measured loop in a forward deflected position removed from said measuring path.

13. The invention according to claim 12 in which said hook members comprise transversely opposed hooks, each hook having a bight portion, each bight portion being an alignment with a corresponding leg of the measured loop for engagement therewith, said hooks further comprising free end portions projecting forward from said bight portions and converging forward and terminating in free ends to engage and move toward each other the legs of the measured loop, as said hooks move rearwardly.

14. An apparatus for making a band from an elongated strip of flexible material comprising:

(a) a securing station for securing two end portions of a strip of flexible material together, (b) means for positioning an elongated strip of flexible material having a lead end in a measuring path below said securing station, (c) measuring means for moving a loop of the strip from said measuring path downward below said securing station a predetermined measured distance to form a measured loop, (d) knife means for severing the measured loop from the remaining portion of the strip, (e) load means for clamping the end portions of the measured loop comprising:

(1) a load carriage, (2) clamp fingers on said load carriage, (3) a clamp plate below said securing station for engagement with said clamp fingers for securing the opposite free end portions of the measured loop in clamping position, (4) means on said load carriage for moving said clamp fingers to said clamping position, (5) means for retracting said clamp fingers to a measured support position for supporting transverse spaced portions of the strip while said strip is moved by said measuring means, and (f) means for positioning the clamped free end portions of the measured loop in said sealing station for sealing.

15. The invention according to claim 14 in which said means for positioning said free end portions in said sealing station comprises a pair of push-up fingers mounted on said load carriage and means for projecting said push-up fingers upward along the opposite sides of the sealing station after the end portions of said measured loops have been clamped by said clamp fingers, and further comprising means for wiping the free end portions of the loop laterally toward each other across said sealing station.

16. The invention according to claim 15 further comprising ejection means, motive means for reciprocably moving said ejection means between a retracted position adjacent said sealing station and a protracted ejection position, said wiper means comprising a pair of wiper fingers pivotally mounted upon said ejection means for rotating toward each other and engaging said pushed-up end portions for overlaying the securing station when said ejection means is in said retracted position, and clamp means on said ejection means for clamping said overlapped end portions in said retracted position at said sealing station.

17. The invention according to claim 16 further comprising means for opening said clamp means at said ejection position for releasing said loop after said end portions have been sealed, and stripping means for removing said loop from said ejection means after said clamp means have been opened in said ejection position.

18. In an apparatus for making a band from an elongated strip of flexible material in which the strip of material is drawn from a source of the strip material toward a measuring station, measuring means for measuring a loop of the material at the measuring station, means for severing the measured strip from the remaining material, and means for sealing the free end portions of the loop to form a band, an oscillating feed mechanism comprising:

(a) a base (b) an arm having a free end portion mounted on said base for reciprocable movement about a pivotal axis, (c) motor means for oscillating said arm about said pivotal axis, (d) a guide on the free end portion of said arm for carrying a strip moving from its source to the measuring station, and (e) means for driving said motor means for oscillating said arm whereby the strip carried by said guide is straightened and removed of wrinkles and twisted portions.

* * * * *